US007618356B1

(12) United States Patent
Johnson et al.

(10) Patent No.: US 7,618,356 B1
(45) Date of Patent: Nov. 17, 2009

(54) EXERCISE APPARATUS INCLUDING A RESISTANCE TRAINING ASSEMBLY COUPLED WITHIN AN EXERCISING SHOE

(76) Inventors: Blanca Johnson, 1403 Fellowship Ct., Toms River, NJ (US) 08755; Tyrone Johnson, Jr., 1403 Fellowship Ct., Toms River, NJ (US) 08755

( * ) Notice: Subject to any disclaimer, the term of this patent is extended or adjusted under 35 U.S.C. 154(b) by 0 days.

(21) Appl. No.: 12/321,437

(22) Filed: Jan. 21, 2009

(51) Int. Cl.
*A63B 21/02* (2006.01)
*A63B 21/045* (2006.01)
*A43B 23/00* (2006.01)

(52) U.S. Cl. ..... 482/124; 482/127; 36/136

(58) Field of Classification Search ..... 482/121, 482/124, 127, 79–80, 74–77; 36/132, 136
See application file for complete search history.

(56) References Cited

U.S. PATENT DOCUMENTS

| | | | | | |
|---|---|---|---|---|---|
| 3,979,842 | A * | 9/1976 | Texidor | 36/115 |
| 5,062,642 | A * | 11/1991 | Berry et al. | 473/277 |
| 5,545,113 | A | 8/1996 | Bobich | 482/125 |
| 5,916,071 | A * | 6/1999 | Lee | 482/77 |
| 5,918,502 | A * | 7/1999 | Bishop | 73/172 |
| 6,094,844 | A * | 8/2000 | Potts | 36/136 |
| 6,361,516 | B1 * | 3/2002 | Hamel | 602/27 |
| 6,629,698 | B2 * | 10/2003 | Chu | 280/11.19 |
| 6,835,169 | B2 | 12/2004 | Tamaribuchi | 482/139 |
| 7,087,003 | B1 | 8/2006 | Katterjohn | 482/124 |
| 7,214,171 | B2 | 5/2007 | Thelen | 482/124 |
| 2006/0183609 | A1 | 8/2006 | Flynn | 482/124 |
| 2007/0060454 | A1 | 3/2007 | Vogel | 482/121 |
| 2007/0155600 | A1 | 7/2007 | Cunningham | 482/121 |
| 2007/0287615 | A1 | 12/2007 | Gilchrist | 482/124 |
| 2008/0045389 | A1 | 2/2008 | Bruce | 482/112 |

* cited by examiner

*Primary Examiner*—Fenn C Mathew
(74) *Attorney, Agent, or Firm*—Law Offices of J. D. Geraigery, P.C.; Janine D. Geraigery, Esq.

(57) ABSTRACT

An improved exercise apparatus including a resistance training assembly coupled within an exercising shoe. The exercise shoe has a durable heel portion including a hollow placement slot having a contoured interior cavity for accepting the resistance training assembly. The interior cavity includes an upper and lower surface each having a pin hole. The assembly includes a detachable handle, a retractable wheel coil having a durable locking center pin, a retractable mechanism, and a locking mechanism. A segment of strap material, namely a resistance band, has a first end removably coupled to the locking center pin, and a second end removably coupled to a detachable handle. The detachable handle has a hollow interior grip portion. A cover removably fastens over the detachable handle and the hollow placement slot.

15 Claims, 3 Drawing Sheets

EXERCISE APPARATUS INCLUDING A RESISTANCE TRAINING ASSEMBLY COUPLED WITHIN AN EXERCISING SHOE

BACKGROUND OF THE INVENTION

1. Field of the Invention

The invention relates to exercise devices, and more particularly, to an improved exercise apparatus including a resistance training assembly coupled within an exercising shoe.

Many exercises incorporate the use of elastic bands for total body conditioning and training. For certain exercises, the bands are utilized by placing them under the shoe's of the user. All too often, the bands slip out from under user's shoes. Not only is this distraction inconvenient, but it detracts from the focus of exercising, making it a much less enjoyable process. The frustration often leads to abandoning the use of the resistance bands, or even giving up on exercising entirely. The present invention seeks to optimize the overall quality of the user's workout by providing resistance bands that are easily pulled out of a built in coil inside the sole of the shoe. This thereby prevents the accidental disconnection and slippage of the band from under shoe.

With the increased attention on the benefits of exercising for overall health and longevity, users are looking to many different forms of exercise. Walking, running and cross training are among the most popular. Resistant bands currently known in the art are not suitable for this type of activity because there is no place to secure the bands while still walking or running. The present invention effectively uses the resistance bands while walking and running, a significant advantage over the prior art.

In the United States, there are 42.7 million people-who have gym memberships. On average these members go to the gym on a regular basis. As they are traveling from their homes or their offices to the gym, they do not want to carry gym equipment to add weight to their daily load. With the hectic schedules many members face, rushing to the gym is not uncommon. Under these hectic circumstances, forgetting to pack everything is a common occurrence. This is another advantage the prior art seeks to eliminate. The present invention specifically eliminates the burden of carrying excessive exercising equipment, and preventing users from forgetting their equipment.

For those who cannot go to the gym on a daily basis because of hectic work schedules or obligations at home, working out is still possible with the present invention. Users can still commit to a daily workout in the comforts of their own home or office. This invention is a comparable substitute that brings a rigorous gym workout to you wherever you are.

It is utilized for exercising the upper, lower, and core parts of the body. Notably, it does not require supervision from a personal trainer, and it is rather intuitive for a person to learn the workouts using the resistance bands. Many Americans also work extra shifts, or long hours, leaving barely any time in the day for exercising. For these busy workers, they can use the invention during convenient times of their day. They can work out while walking home from work, or while they are running their errands.

When a person has traveled far away from home on vacation or a business trip, the invention allows the user to exercise on their own from anywhere. Be it thousands of miles from the gym, while on vacation or business, the present invention allows the user to continue their daily exercise routine, with the full gym being carried in the shoe.

2. Description of the Related Art

United States Pat. Application No. 2006/0183609 to Flynn discloses a strap apparatus for stretching and strengthening muscles and connective tissue, and includes a segment of strap material having a first end, a medial portion, and a second end, having a loop formed in the first end, length adjustment means formed in the medial portion, and a connector element attached to the second end. The connector element is adapted for releasable connection to an anchor article, e.g. an extremity cuff member or a clothing article, bearing a receiver adapted for releasable attachment to the connector element.

United States Pat. Application No. 2007/0060454 to Vogel discloses a method and apparatus of attaching exercise equipment, such as various lengths and configurations of elastic resistance tubing, to athletic footwear. Among the many configurations of the invention is whereby the elastic tubing and handle assembly is permanently connected to the sneaker. Another configuration of the invention is the use of the elastic tubing and handle assembly being equipped with an end clip fastener that can be easily and quickly fastened to and/or unfastened from a sneaker or other type of footwear. Other improvements include a reinforcement ring that may be attached to one or more laces of the shoe and/or other components such as VELCRO strips that can be attached to the body of an athletic shoe to make the attachment, stowage and use of the elastic cord and handle assembly more secure and safer during use.

U.S. Pat. No. 7,087,003 to Katterjohn discloses an exercise system and method of use to achieve numerous workout possibilities without requiring attachment of the device to a fixed object such as a door or wall. The system includes a specially designed shoe clip for attachment to the front end of an exercise or tennis shoe. A strapping element, for use in conjunction with the shoe clip, is also specially designed for the overall system. The system and method are applicable for a wide variety of workout routines. The system includes attachment devices so that stretchable resistance bands or stretchable tubing material can be easily changed to vary the workout difficulty as desired.

U.S. Pat. No. 6,835,169 to Tamaribuchi discloses a left and right hand exercisers are formed based upon a modification of the handgrips disclosed and claimed in U.S. Pat. No. 5,979,015, wherein a throughbore is made through the grip, generally vertically through the elongation of the grip, at an angle between 82 and 88 degrees. A flattened tube of nylon webbing, or equal, is disposed through the throughbore, and is either connected to itself to form an endless loop spaced from the body of the grip in one embodiment. In another embodiment, the webbing passing through the bottom end of the grip is retained in place by one of several means. The end of the webbing emanating from the top of the grip may be attached directly to an elastic tube or band, or to a swivel split ring. If the latter, cables or other devices can be appended to the split ring as is known to the art.

While these units may be suitable for the particular purpose employed, or for general use, they would not be as suitable for the purposes of the present invention as disclosed hereafter.

SUMMARY OF THE INVENTION

It is an object of the invention to provide an improved exercise apparatus that includes a resistance training assembly interchangeably coupled within an exercising shoe.

It is an object of the invention to provide a resistance training assembly that is either permanently or interchangeably connected within the shoe.

It is yet another object of the present invention to be quickly and easily adjusted for different lengths and levels of resistance training and for performing a multitude of exercises without having to change the invention, or remove the shoe, and without undue wear.

It is an object of the invention to provide an exercising shoe capable of accepting the resistance training assembly within the heel. Accordingly, the show of the present invention includes a heel having a placement slot including an interior cavity contorted in design, and approximately one half inch in height, for adequately accept the resistance training assembly.

It is an object of the invention to provide an interchangeable resistance training assembly for strengthening and stretching muscles and connective tissue. Accordingly, the assembly includes a retractable wheel coil having a locking center pin, a segment of strap material, and a handle, for either the assembly being removed and interchanged entirely or for removing the handle and interchanging the segment of strap material only.

It is an object of the invention to provide a segment of strap material that is an elastic resistance band, preferably made of a flat and ergonomical material.

It is an object of the invention to provide strap material that is interchangeable and most notably different thicknesses, to provide for different levels of resistance training. For first time users, it is preferred to start with a thin, light strap material, and gradual progress to a thicker strap material as fitness levels increase.

It is an object of the invention to provide a wheel coiling have a retractable mechanism, preferably a spring loaded mechanism that is actuated during an exercise routine to enable the wheel coil to provide resistance during this time.

It is an object of the invention to provide a wheel coil that has a locking mechanism for stopping the natural retracting mechanism and thereby stopping the strap material from coiling around a locking pin at any one of a plurality of desired positions. Accordingly, the locking mechanism is utilized for a variety of exercises, when different strap material lengths are required, and thus the strap material can be uncoiled or coiled and locked in position at the perfect length.

It is an object of the invention to provide a button, in connection and communication with the locking pin of the wheel coil, for controlling the retracting and locking mechanisms. More specifically, by pressing the button once and pulling the strap material, the apparatus allows the strap material to be selectively uncoiled. If the user chooses, they can press the button again actuating the locking mechanism to lock the wheel coil and thus lock the strap material in position at a desired length. Finally, by pressing and holding the button, while also letting go of the strap material, causes the retracting mechanism to be actuated and recoil the strap material automatically.

It is an object of the invention to provide a ergonomically designed detachable handle.

It is yet another object of the invention to provide a mounting structure, preferably a recessed edge, within the opening of the placement slot for securing the detachable handle therein.

It is an object of the invention to provide a removable cover for covering the detachable handle and hollow placement slot, when not in use.

It is an object of the invention to provide an apparatus capable of allowing users to exercise while on the go, traveling, away from home and the gym.

It is an object of the invention to provide an apparatus capable of allowing users to complete resistance training exercises based on their level of fitness.

It is an object of the invention to provide an apparatus capable of allowing users to increase the difficulty of their exercise routines by simple interchanging resistance assemblies as desired.

It is an object of the invention to provide an apparatus having resistance band technology that is capable of being used while walking, running, or bike riding.

It is an object of the invention to provide an apparatus for allowing users to perform hundreds of different exercises and exercising routines.

This invention is an improved exercise apparatus including a resistance training assembly coupled within an exercising shoe. The exercise shoe has a durable heel portion including a hollow placement slot having a contoured interior cavity for accepting the resistance training assembly. The interior cavity includes an upper and lower surface each having a pin hole. The assembly includes a detachable handle, a retractable wheel coil having a durable locking center pin, a retractable mechanism, and a locking mechanism. A segment of strap material, namely a resistance band, has a first end removably coupled to the locking center pin, and a second end removably coupled to a detachable handle. The detachable handle has a hollow interior grip portion. A cover removably fastens over the detachable handle and the hollow placement slot.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
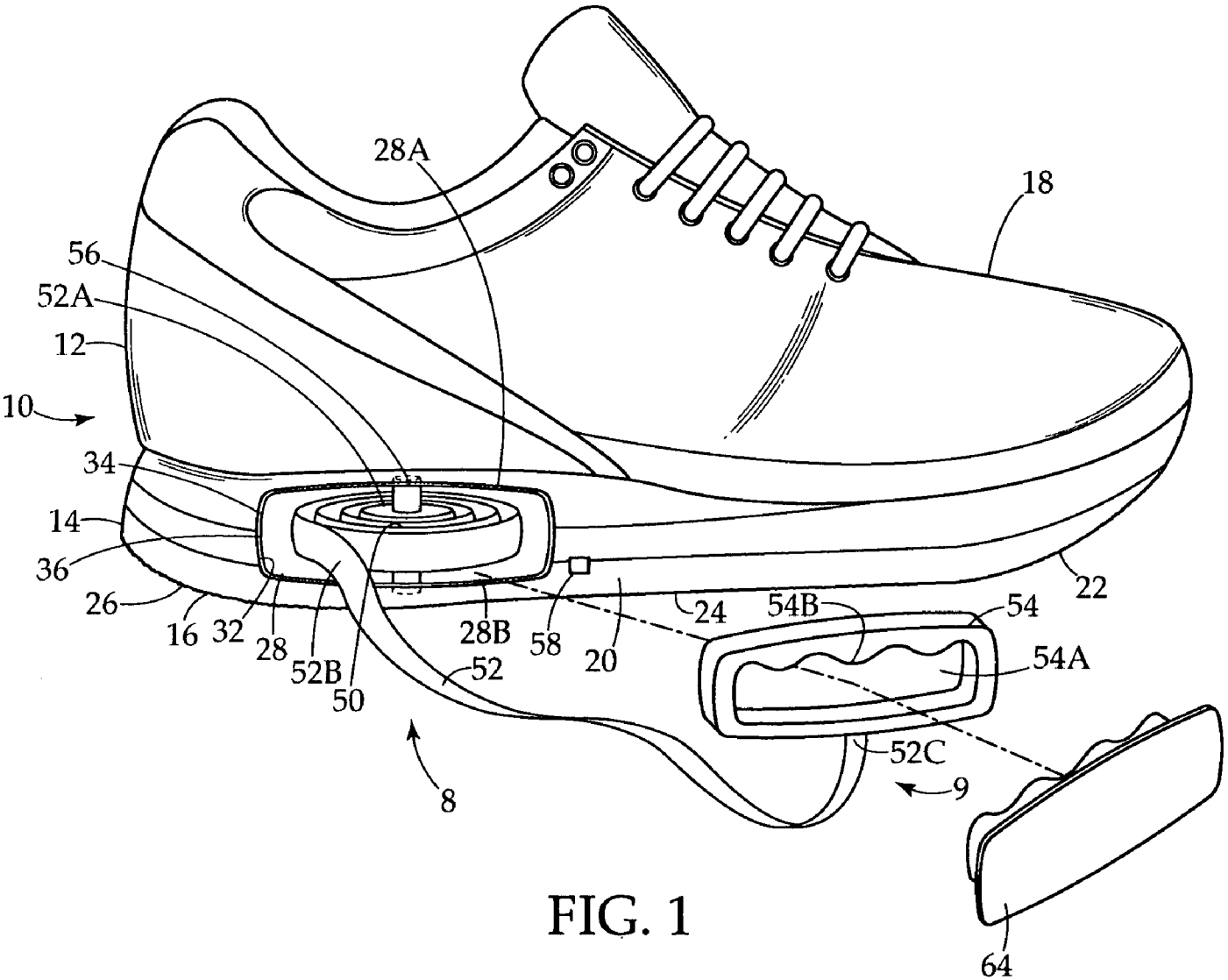
FIG. 1 is a diagrammatic perspective view of an improved exercise apparatus including a resistance training assembly coupled within an exercising shoe.

FIG. 1 illustrates an improved exercise apparatus 8 including a resistance training assembly 9 coupled within an exercising shoe 10. Among the many configurations of the invention is whereby the resistance training assembly 9 is permanently connected within the shoe 10. Another configuration and the preferred embodiment of the present invention, is the use of the resistance training assembly 9 being interchangeable within the shoe 10, without having to remove the shoe.

The shoe 10 is substantially similar to most sneakers or athletic footwear. The exercising shoe 10 may be generally described as having a foot portion 12 and a sole 14. The foot portion 12 may be made up of virtually any material such as, for example, leather, plastic, or canvas. The sole 14 is preferably made of durable material, such as rubber and preferably includes a textured bottom surface 16 to create traction. The shoe 10 generally includes an inner side 18 and outer side 20. The sole 14 is divided into three portions including a forefoot portion 22, an arch portion 24, and a heel portion 26.

It should be noted that the forefoot, arch, and heel portion of the sole 14 are incapable of being exactly defined and located and such process vary from one footwear type to another. Thus, the location, the boundaries between, and the size of the portions are only rough approximations.

Figure 2:
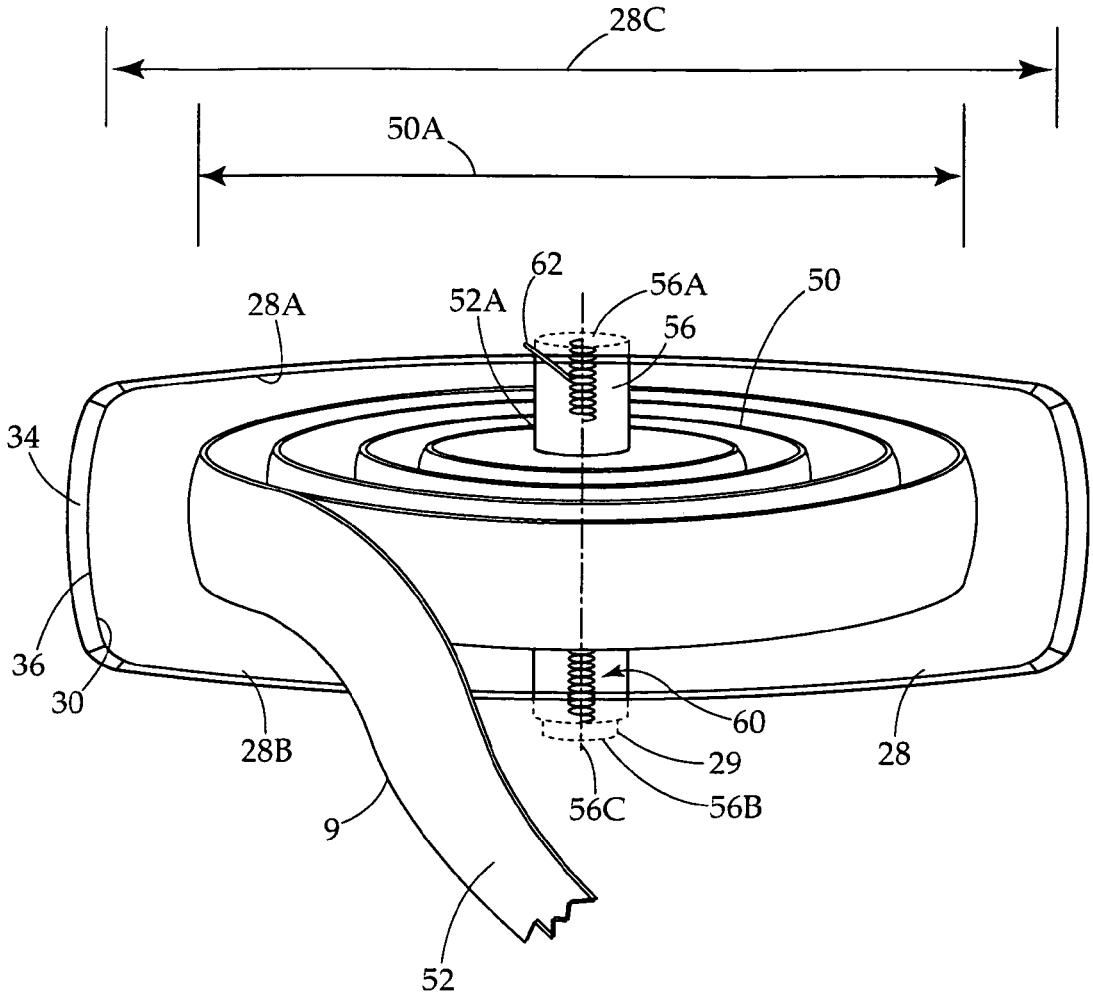
FIG. 2 is a exploded view of the hollow placement slot accepting the resistance training assembly of the present invention.

The heel portion 26 is made of substantial strong material to hold a hollow placement slot 28. Referring to FIG. 2, the resistance training assembly 9 is preferably accepted into the hollow placement slot 28 of the heel portion 26 of the sole 14. In alternate embodiments, the placement slot 28 is positionable near the boundary of the heel portion 26 and the arch portion 24. The hollow placement slot 28 includes an interior cavity 30, an upper and lower surface 28A and 28B respectively, and at least one opening 32. The upper and lower surfaces 28A and 28B each include a pin hole 29, wherein the pin holes 29 are positionable along a similar vertical plane. While it is contemplated that the interior cavity 30 may extend entirely through the sole 14 of the shoe 10 from the inner side 18 to the outer side 20, it is preferable that the interior cavity 30 has only one opening 32 accessible from the outer side 20 of the shoe 10. The interior cavity 30 is contorted in design, and approximately one half inch in height, for adequately accept the resistance training assembly 9.

Figure 3:
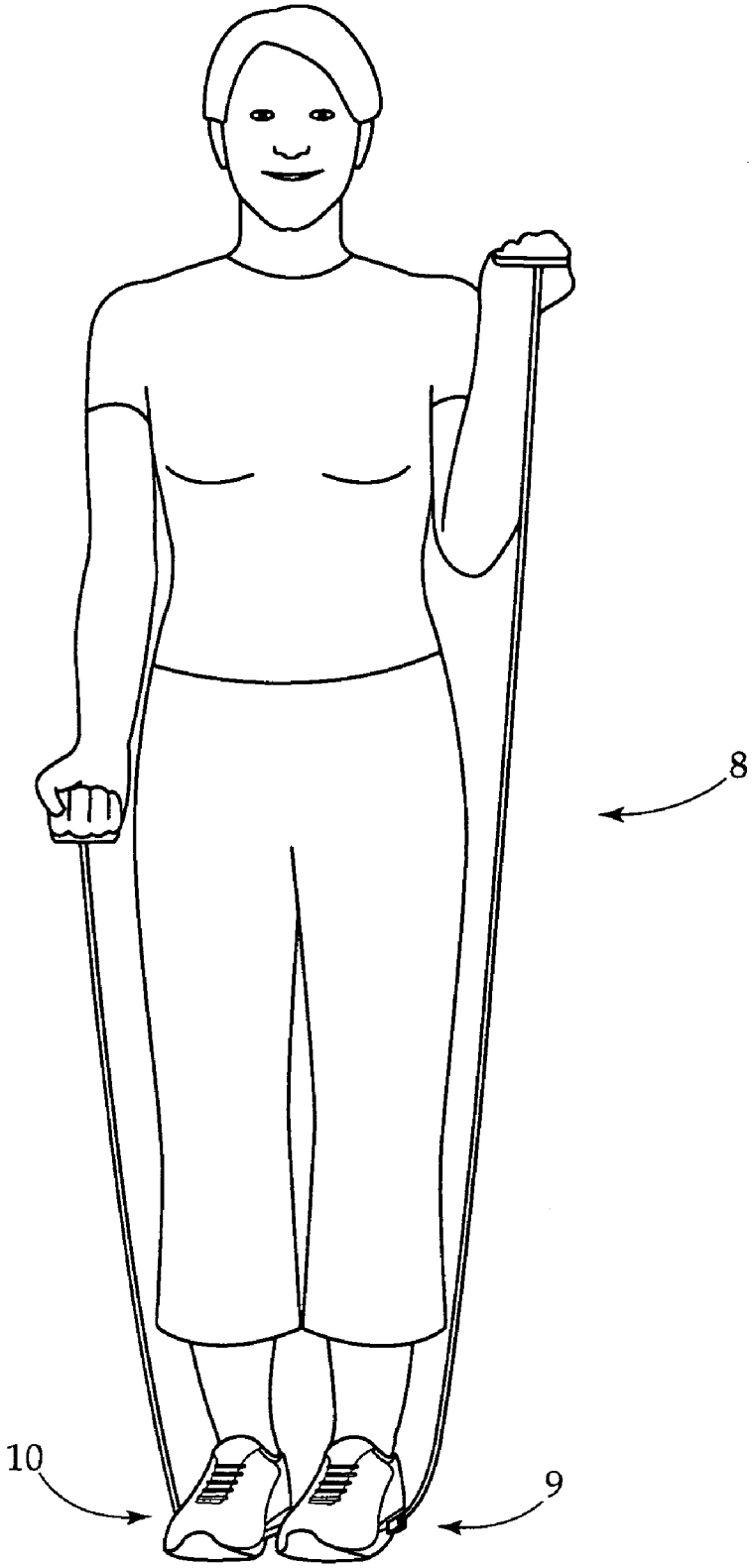
FIG. 3 is a diagrammatic perspective view of the improved exercise apparatus wherein the resistance training assembly is in use during exercising a user's biceps.

Referring to FIGS. 1 and 3, the interchangeable resistance training assembly 9 is provided for strengthening and stretching muscles and connective tissue and in its broadest context includes a retractable wheel coil 50 having a locking center pin 56, a segment of strap material 52, and a handle 54. The segment of strap material 52 includes a first end 52A, a medial portion 52B and a second end 52C. The first end 52A of the strap material 52 is integrally coupled to the locking center pin 56, preferably made of steel or other hard and durable material, and the medial portion 52B of the strap material 52 is coiled around the pin 56. The second end 52C of the strap material 52 is integrally coupled to a detachable handle 54. The locking pin 56 includes a top end 56A and a bottom end 56B wherein at least one end is spring loaded.

The segment of strap material 52 is preferably an elastic resistance band. More specifically, the elastic resistance band is preferably flat shaped and made of ergonomic material. In is contemplated that the strap material 52 can be made of any of a plurality of materials including resistance tubing, bungee cord, elastic bands, or springs and can be of various lengths and/or thickness to yield varying amounts of resistance and appropriateness for various specific exercises. Interchangeable wheel coils 50 are contemplated in the present invention, such that various strap materials 52 can be interchanged within the shoe 10 to provide different levels of resistance exercise as desired. The detachable handle 54 is easily removable and interchangeable from one the second end 52C of the strap material 52 to another as desired.

The wheel coil 50 may be built into the shoe, or in the preferred embodiment is inserted into the placement slot 28. To insert the wheel coil 50 into the placement slot the locking pin 56 is used and positionable in a vertical orientation along its vertical axis 56C. The top end 56A of the locking pin 56 is removably secured into the pin hole 29 of the upper surface 28A of the placement slot 28, while the bottom end 56B of the locking pin 56 is removably secured within the pin hole 29 of the lower surface 28B of the placement slot 28.

Once accepted into the placement slot 28, the wheel coil 50 is oriented in a horizontal position, where the diameter 50A of the wheel coil is less than the diameter 28C of the placement slot 28. The wheel coil 50 turns along the axis 56C of the locking pin 50 in a clockwise orientation, and while exercising is pulled preferably in a counterclockwise direction, thereby allowing the segment of strap material 52 to exit the shoe 10 through the outer side 20.

The wheel coil 50 has a resting position 50B and a working position 50C, and also includes a retractable mechanism 60 and a locking mechanism 62. The retractable mechanism 60 is preferably a spring loaded mechanism that is automatically actuated during the working position 50C and enables the wheel coil 50 to provide resistance during this time. The wheel coil 50 is naturally coiled clockwise when it's in its resting position 50C. Each time the user pulls the strap material and turns the wheel coil 50 counterclockwise, the wheel coil 50 is in its working position 50C whereby it naturally provides resistance in its effort to turn back clockwise. The locking mechanism 62 stops the natural retracting mechanism 60 and thereby stops the strap material from coiling around the locking pin 56 at any one of a plurality of desired positions. This locking mechanism 62 is thereby utilized in a variety of exercises during the active form, when different strap material 52 lengths are required, and thus the strap material can be uncoiled or coiled and locked in position at the perfect length. In the preferred embodiment, a button 58, in connection and communication with the locking pin 56, is positionable along the outer side 20 of the shoe 10. Pressing the button 58 once and pulling the strap material 52, allows the strap material to be selectively uncoiled. If the user chooses, they can press the button again actuating the locking mechanism 62 to lock the wheel coil 50 and thus lock the strap material in position at a desired length. Pressing and holding the button, while letting go of the strap material 52 causes the retracting mechanism 60 to be actuated and recoil the strap material 52 automatically.

Specifically, the opening 32 of the placement slot 28 includes a mounting structure 34, preferably a recessed edge 36. The recessed edge 36 is preferably made of plastic material and functions to secure the detachable handle 54 onto the outer side 20 of the shoe 10. The detachable handle 54 is substantially rectangular in shape and ergonomically designed having a hollow interior grip portion 54A. The grip portion 54A has a plurality, preferably five, individual indentations or groves 54B each accommodating one of the fingers of the gripping hand. The handle 54 is preferably made of plastic material, wherein the grip portion 54A is preferably be made of soft sponge material, such as rubber or foam. The mounting structure 34 is contoured to accept the ergonomic design of the handle 54. In alternative embodiments, the handle 54 is detachable when the assembly 9 is in its inactive form 9A. In additional embodiments, hook and look or snap fasteners, or the like, may be utilized to attach the handle 54 to the outer side 20 of the shoe 10.

A removable cover 64 is provided for covering the detachable handle 54 and hollow placement slot 28. The cover 64 is substantially rectangular and locks into the hollow interior grip portion 54A of the detachable handle when the handle 54 is locked into the mounting structure 34 and the assembly is in its inactive form 9A. The cover 64 prevents dirt and debris from entering the opening 32 of the placement slot 28 when the assembly is not being used.

The resistance training assembly 9 has an inactive form 9A and an active form 9B. In the inactive form 9A, the strap material 52 is coiled around the wheel coil 50 undisturbed. The inactive form 9A is utilized when the user is not using the assembly 9 of the shoe 10. The wheel coil 50 includes the retractable mechanism 60 which insures that the handle 54 and strap material 52 remain coiled in around the locking pin 56 within the placement slot 28.

In its active form 9B, the strap material 52 of the resistance training assembly 9 is pulled outwardly by first detaching the handle 54 from the mounting structure 34. As the strap material 52 exits the shoe 10, the material 52 is selectively lengthened and raised to a desired height for performing one of a plurality of exercises. In some exercises, the user will pull out the strap material 52 to nearly expose the first end 52A and this is considered a fully extended strap material 52. The strap-material is interchangeable and most notably different thicknesses, to provide for different levels of resistance training. For first time users, it is preferred to start with a thin, light strap material, and gradual progress to a thicker strap material as fitness levels increase.

In use, a plurality of different exercises are contemplated for allowing users to perform resistance training. To perform the user's desired exercises, the strap material 52 is appropriately locked into a desired length using the button 58 to actuate the locking mechanism Some fitness experts suggest that the strap material 52 should only be stretched three times their length because they are capable of breaking if stretched further. Some exercises that are performed using the present invention include, but are not limited to, double leg raises, over head press, bicep oblique bends, outer thighs, and single leg raise.

For exercises, such as bicep curls, forward leg raises, and squat lateral raises, it is desirable to have a shorter length strap material 52 for the user to perform the exercise effectively. In performing almost all exercises, the user first removes the cover 64 and then detaches the handle 54 from the mounting structure 34. Next, the user may choose to extend the strap material 52 and press the button 58 actuating the locking mechanisms 62 to secure the desired length of the strap material 52. Then the user exercises as desired.

Specifically, in performing a bicep curl, the user first removes the cover 64 and then detaches the handle 54 from the mounting structure 34. The user then grips the handle 54, such that their finger tips are orientated to face the body, and their thumbs are touching the top outer exterior of the handle. As the user pulls the handle upwardly, bending the arm at the elbow, the strap material 52 starts to uncoil. As the strap material 52 uncoils, the locking pin 56 turn counterclockwise along its axis 56C and the strap material slowly exits the placement slot 28 through the opening 32. The user continues to pull the handles 54 bending the arms at the elbow and curling the biceps and thus pulling the strap materials 52 out further from the wheel coils 50, thereby using their biceps to curl the handles 54 upwardly toward their chin. Next, the user slow lengthens their arms back downwardly in a controlled motion, such that their arms are elongated toward the sides of their body. The strap material 52 naturally-retracting back into the placement slot 28 as the wheel coil 50 naturally turns clockwise along its axis 56C.

In summary, the present invention can quickly and easily be adjusted to different lengths and levels of resistance for performing a multitude of exercise without having to change the invention and without undue wear.

In conclusion, herein is presented an improved exercise apparatus including a resistance training assembly coupled within an exercising shoe. The invention is illustrated by example in the drawing figures, and throughout the written description. It should be understood that numerous variations are possible, while adhering to the inventive concept. Such variations are contemplated as being a part of the present invention.

What is claimed is:

1. An improved exercise apparatus, comprising:

an exercising shoe having a foot portion, a sole, an inner side and outer side, wherein the sole including a forefoot portion, an arch portion, and a durable heel portion, wherein said durable heel portion includes a hollow placement slot having a contoured interior cavity having a diameter, an upper and lower surface, and at least one opening, wherein said upper and lower surfaces each having a vertical, pin hole, wherein said pin holes are positionable along common axis;

an resistance training assembly removably coupled within said interior cavity of said hollow placement slot of said exercising shoe, said assembly comprising; and a retractable wheel coil having a diameter smaller than said diameter of said interior cavity of said placement slot for being insertable horizontally into said placement slot and having a durable locking center pin including a top end and a bottom end, wherein at least one end is spring loaded, wherein said locking center pin includes a vertical axis for rotating said wheel coil therearound in a clockwise orientation, wherein said top end of said locking center pin is removably secured into said pin hole of said upper surface of said placement slot, and wherein said bottom end of said locking center pin is removably secured within said pin hole of said lower surface of said placement slot, wherein said wheel coil having a resting position and a working position, and a retractable mechanism and a locking mechanism, wherein said retractable mechanism is a spring loaded mechanism actuated during said working position for enabling said wheel coil to provide resistance, wherein said locking mechanism stops said retracting mechanism and prevents said strap material from coiling around said locking center pin;

a segment of strap material including a first end, a medial portion and a second end, wherein said first end is removably coupled to said locking center pin, said medial portion is coiled around said locking pin;

a detachable handle substantially rectangular and having a hollow interior grip portion having a plurality of gripping indentations, wherein said second end of said strap material is removably coupled to said detachable handle; and a substantially rectangular removable cover for covering said detachable handle and said hollow placement slot, wherein said cover locks into said hollow interior grip portion of said detachable handle.

2. The improved exercise apparatus of claim 1, wherein the resistance training assembly is interchangeably connected within the shoe.

3. The improved exercise apparatus of claim 1, wherein the segment of strap material is a flat elastic resistance band.

4. The improved exercise apparatus of claim 1, wherein the segment of strap material is interchangeable.

5. The improved exercise apparatus of claim 1, wherein said pin holes are positionable along a common axis and hollow cavity extends entirely through the sole of the shoe from the inner side to the outer side.

6. The improved exercise apparatus of claim 1, further comprising a button positionable along the outer side of the shoe, and being in connection and communication with the locking center pin for actuating the locking mechanism or the retracting mechanism.

7. The improved exercise apparatus of claim 1, wherein the opening includes a mounting structure having a recessed edge for securing the detachable handle thereto.

8. A method of resistance training using the improved exercise apparatus of claim 1, the steps comprising:

detaching the handle from the mounting structure;

pulling the strap material outwardly from the placement slot of the shoe by the detachable handle;

raising the segment of strap material to a predetermined height by uncoiling the strap material by pressing the button once and pulling the strap material; and exercising using resistance training from the strap material.

9. The method of resistance training of claim 8, the steps further comprising actuating the locking mechanism to lock the wheel coil and lock the strap material to a predetermined length by pressing the button again.

10. The method of resistance training of claim 9, the steps further comprising actuating the retracting mechanism to recoil the strap material within the placement slot by pressing and holding the button.

11. The method of resistance training of claim 8, the steps further comprising removing the detachable handle and removing and interchanging the segment of strap material.

12. The method of resistance training of claim 8, the steps further comprising removing and interchanging the wheel coil.

13. An improved exercise apparatus, comprising:

an exercising shoe having a foot portion, a sole, an inner side and outer side, wherein the sole including a forefoot portion, an arch portion, and a durable heel portion, wherein said durable heel portion includes a hollow placement slot having a contoured interior cavity having a diameter, an upper and lower surface, and at least one opening, wherein said opening includes a mounting structure having a recessed edge, wherein said upper and lower surfaces each having a vertical pin hole, wherein said pin holes are positionable along common axis;

an interchangeable resistance training assembly removably coupled within said interior cavity of said hollow placement slot of said exercising shoe, said assembly comprising: and a retractable wheel coil having a diameter smaller than said diameter of said interior cavity of said placement slot for being insertable horizontally into said placement slot and having a durable locking center pin including a top end and a bottom end, wherein at least one end is spring loaded, wherein said locking center pin includes a vertical axis for rotating said wheel coil therearound in a clockwise orientation, wherein said top end of said locking center pin is removably secured into said pin hole of said upper surface of said placement slot, and wherein said bottom end of said locking center pin is removably secured within said pin hole of said lower surface of said placement slot, wherein said wheel coil having a resting position and a working position, and a retractable mechanism and a locking mechanism, wherein said retractable mechanism is a spring loaded mechanism actuated during said working position for enabling said wheel coil to provide resistance, wherein said locking mechanism stops said retracting mechanism and prevents said strap material from coiling around said locking center pin;

an interchangeable segment of strap material substantially a flat elastic resistance band including a first end, a medial portion and a second end, wherein said first end is integrally coupled to said locking center pin, said medial portion is coiled around said locking pin;

a detachable handle substantially rectangular and having a hollow interior grip portion having a plurality of gripping indentations, wherein said second end of said strap material is removably coupled to said detachable handle and wherein said detachable handle is securable to said recessed edge of said mounting structure;

a substantially rectangular removable cover for covering said detachable handle and said hollow placement slot, wherein said cover locks into said hollow interior grip portion of said detachable handle when said detachable handle is secured to said mounting structure.

14. The improved exercise apparatus of claim 13, wherein said pin holes are positionable along a common axis and hollow cavity extends entirely through the sole of the shoe from the inner side to the outer side.

15. The improved exercise apparatus of claim 13, further comprising a button positionable along the outer side of the shoe, and being in connection and communication with the locking center pin for actuating the locking mechanism or the retracting mechanism.

* * * * *